US008091267B2

(12) United States Patent
Moore et al.

(10) Patent No.: US 8,091,267 B2
(45) **Date of Patent: *Jan. 10, 2012**

(54) GUN-MOUNTED SIGHTING DEVICE

(76) Inventors: Larry E. Moore, Cottonwood, AZ (US); Aaron Moore, Cottonwood, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/077,861

(22) Filed: Mar. 31, 2011

(65) Prior Publication Data

US 2011/0173871 A1 Jul. 21, 2011

Related U.S. Application Data

(63) Continuation of application No. 12/249,785, filed on Oct. 10, 2008.

(60) Provisional application No. 61/094,765, filed on Sep. 5, 2008.

(51) Int. Cl.
*F41G 1/00* (2006.01)

(52) U.S. Cl. ..... 42/117; 42/114; 42/115; 42/132; 42/146; 362/553; 362/259

(58) Field of Classification Search ..... 42/114, 42/115, 117, 132, 146; 362/553, 259, 555, 362/800

See application file for complete search history.

(56) References Cited

U.S. PATENT DOCUMENTS 3,112,567 A 12/1963 Flanagan
3,645,635 A * 2/1972 Steck ..... 356/252
3,801,205 A 4/1974 Eggenschwyler
4,233,770 A * 11/1980 de Filippis et al. ..... 42/114
4,305,091 A * 12/1981 Cooper ..... 348/619
4,481,561 A 11/1984 Lanning
4,488,369 A * 12/1984 Van Note ..... 42/1.01
4,825,258 A 4/1989 Whitson
4,876,816 A * 10/1989 Triplett ..... 42/115
4,939,863 A * 7/1990 Alexander et al. ..... 42/115
5,033,219 A 7/1991 Johnson
5,237,773 A * 8/1993 Claridge ..... 42/117
5,272,514 A 12/1993 Dor
5,367,779 A 11/1994 Lee
5,373,644 A * 12/1994 DePaoli ..... 42/113
5,375,362 A * 12/1994 McGarry et al. ..... 42/117

(Continued)

FOREIGN PATENT DOCUMENTS

EP 1046877 10/2000

OTHER PUBLICATIONS

USPTO; Office Action date Dec. 26, 2008 in U.S. Appl. No. 11/317,647.

(Continued)

*Primary Examiner* — Michael David
(74) *Attorney, Agent, or Firm* — David E. Rogers; Snell & Wilmer LLP

(57) ABSTRACT

A sighting device is mountable to a gun. The device includes a light source (preferably a laser), a power source connectable to the light source and a mount attachable to the gun so that the laser is juxtaposed either the top surface of the gun or a side surface of the gun. In one embodiment, the sighting device includes a bottom rail mountable in a slot on the gun, wherein the slot is preferably positioned on the top surface of the gun. The sighting device may also include a mechanical sight that functions as the rear mechanical sight on the gun and/or a secondary light source.

77 Claims, 19 Drawing Sheets

U.S. PATENT DOCUMENTS

| | | | | |
|---|---|---|---|---|
| 5,388,335 | A | 2/1995 | Jung | |
| 5,392,550 | A * | 2/1995 | Moore et al. | 42/117 |
| 5,419,072 | A * | 5/1995 | Moore et al. | 42/117 |
| 5,435,091 | A * | 7/1995 | Toole et al. | 42/117 |
| 5,454,168 | A | 10/1995 | Langner | |
| 5,499,455 | A | 3/1996 | Palmer | |
| 5,515,636 | A * | 5/1996 | McGarry et al. | 42/117 |
| 5,531,040 | A * | 7/1996 | Moore | 42/115 |
| 5,566,459 | A | 10/1996 | Breda | |
| 5,590,486 | A * | 1/1997 | Moore | 42/114 |
| 5,621,999 | A * | 4/1997 | Moore | 42/117 |
| 5,671,561 | A * | 9/1997 | Johnson et al. | 42/114 |
| 5,706,600 | A * | 1/1998 | Toole et al. | 42/115 |
| 5,787,631 | A | 8/1998 | Kendall | |
| 6,289,624 | B1 | 9/2001 | Hughes et al. | |
| 6,295,753 | B1 | 10/2001 | Thummel | |
| 6,345,464 | B1 * | 2/2002 | Kim et al. | 42/114 |
| 6,363,648 | B1 * | 4/2002 | Kranich et al. | 42/117 |
| 6,366,349 | B1 | 4/2002 | Houde-Walter | |
| 6,371,004 | B1 | 4/2002 | Peterson | |
| 6,499,247 | B1 | 12/2002 | Peterson | |
| 6,591,536 | B2 * | 7/2003 | Houde-Walter et al. | 42/114 |
| 6,622,414 | B1 | 9/2003 | Oliver et al. | |
| 7,134,234 | B1 * | 11/2006 | Makarounis | 42/146 |
| 7,243,454 | B1 * | 7/2007 | Cahill | 42/72 |
| 7,260,910 | B2 * | 8/2007 | Danielson | 42/117 |
| 7,331,137 | B2 * | 2/2008 | Hsu | 42/114 |
| 7,360,333 | B2 * | 4/2008 | Kim | 42/85 |
| 7,441,364 | B2 * | 10/2008 | Rogers et al. | 42/146 |
| 7,584,569 | B2 * | 9/2009 | Kallio et al. | 42/117 |
| 7,591,098 | B2 * | 9/2009 | Matthews et al. | 42/85 |
| 7,743,546 | B2 | 6/2010 | Keng | |
| 7,921,591 | B1 | 4/2011 | Adcock | |
| 2002/0073561 | A1 | 6/2002 | Liao | |
| 2002/0134000 | A1 | 9/2002 | Varshneya et al. | |
| 2002/0194767 | A1 * | 12/2002 | Houde-Walter et al. | 42/114 |
| 2003/0180692 | A1 | 9/2003 | Skala | |
| 2005/0044736 | A1 | 3/2005 | Liao | |
| 2005/0241209 | A1 * | 11/2005 | Staley, III | 42/111 |
| 2005/0257415 | A1 * | 11/2005 | Solinsky et al. | 42/146 |
| 2005/0268519 | A1 * | 12/2005 | Pikielny | 42/124 |
| 2008/0000133 | A1 * | 1/2008 | Solinsky et al. | 42/115 |
| 2008/0060248 | A1 * | 3/2008 | Pine et al. | 42/114 |
| 2008/0134562 | A1 * | 6/2008 | Teetzel | 42/146 |
| 2009/0013580 | A1 * | 1/2009 | Houde-Walter | 42/114 |
| 2009/0178325 | A1 | 7/2009 | Veilleux | |
| 2009/0293335 | A1 * | 12/2009 | Danielson | 42/117 |
| 2010/0058640 | A1 * | 3/2010 | Moore et al. | 42/114 |
| 2010/0162610 | A1 * | 7/2010 | Moore et al. | 42/115 |
| 2011/0061283 | A1 | 3/2011 | Cavallo et al. | |

OTHER PUBLICATIONS

USPTO; Office Action dated Jun. 19, 2009 in U.S. Appl. No. 11/317,647.
USPTO; Office Action dated Sep. 28, 2009 in U.S. Appl. No. 11/317,647.
USPTO; Notice of Allowance dated Feb. 2, 2011 in U.S. Appl. No. 12/249,794.
USPTO; Office Action dated Oct. 6, 2010 in U.S. Appl. No. 12/249,794.
USPTO; Office Action dated Nov. 8, 2010 in U.S. Appl. No. 12/249,781.
USPTO; Final Office Action dated May 18, 2011 in U.S. Appl. No. 12/249,781.
USPTO; Notice of Allowance dated Mar. 3, 2011 in U.S. Appl. No. 12/249,785.
USPTO; Office Action dated Jun. 22, 2011 in U.S. Appl. No. 13/077,875.
EPO; Search Opinion and Report dated Aug. 6, 2010 in Ser. No. 09 169 459.
EPO; Search Opinion and Report dated Aug. 6, 2010 in Ser. No. 09 169 469.
EPO; Search Opinion and Report dated Aug. 23, 2010 in Ser. No. 09 169 476.

* cited by examiner

GUN-MOUNTED SIGHTING DEVICE

CROSS-REFERENCE TO RELATED APPLICATIONS

This Application is a continuation of and claims priority to U.S. patent application Ser. No. 12/249,785, filed Oct. 10, 2008, which claims priority to U.S. Provisional Patent Application No. 61/094,765, filed Sep. 5, 2008, the contents of each of which are incorporated herein by reference to the extent they do not conflict with the disclosure herein.

FIELD OF THE INVENTION

The present invention relates to a light-emitting sighting device, particularly a laser that is externally mountable on a weapon, the weapon preferably being a gun.

BACKGROUND OF THE INVENTION

It is known to utilize a light beam, such as a laser beam, as a sighting aid for weapons, particularly guns. Lasers are the preferred means of generating light beams for weapon sighting because they have comparatively high intensity and can be focused into a narrow beam with a very small divergence angle so they produce a small, bright spot on a target. The laser projects a narrow beam of light in a direction generally parallel to the gun's bore. When the light beam and bore are properly aligned, the bullet (or other projectile) will hit on or very close to the location of the light beam projected on a target.

As used herein, "laser" includes any form of laser light source, and the term "laser sight" refers to a light emitting module or assembly that projects a beam of light having a small divergence angle suitable for weapon alignment or sighting purposes.

It is known to attach a laser sight to the trigger guard of a hand gun or other weapon. Several types of trigger-guard mounted laser sights are known. A problem associated with trigger-guard mounted laser sights is that trigger guards are complex, three-dimensional shapes with non-uniform cross-sections and it is difficult to mount, align and use the laser light. It is also known to position a laser sight below the gun barrel, for example, on the picatinny rail. When the laser sight is in this position the gun is difficult or impossible to holster and the gun/laser sight usually requires two hands to operate because one hand is required to hold the gun and another to turn the laser off and turn.

SUMMARY OF THE INVENTION

The invention is a sighting device for a gun that includes a light source positioned above or along side (but not below) the barrel of a gun. The device is preferably a laser sight that includes a laser, a power source connectable to the laser and a mount for mounting the sight to a gun. Preferably, the sight is attached to the gun by a mount that can be received and retained in a slot on the top surface of the gun. A sighting device according to the invention may also include a mechanical sight and/or a secondary light source, which may be visible light, an infra-red light or another laser.

DETAILED DESCRIPTION OF PREFERRED EMBODIMENTS

Figure 1:
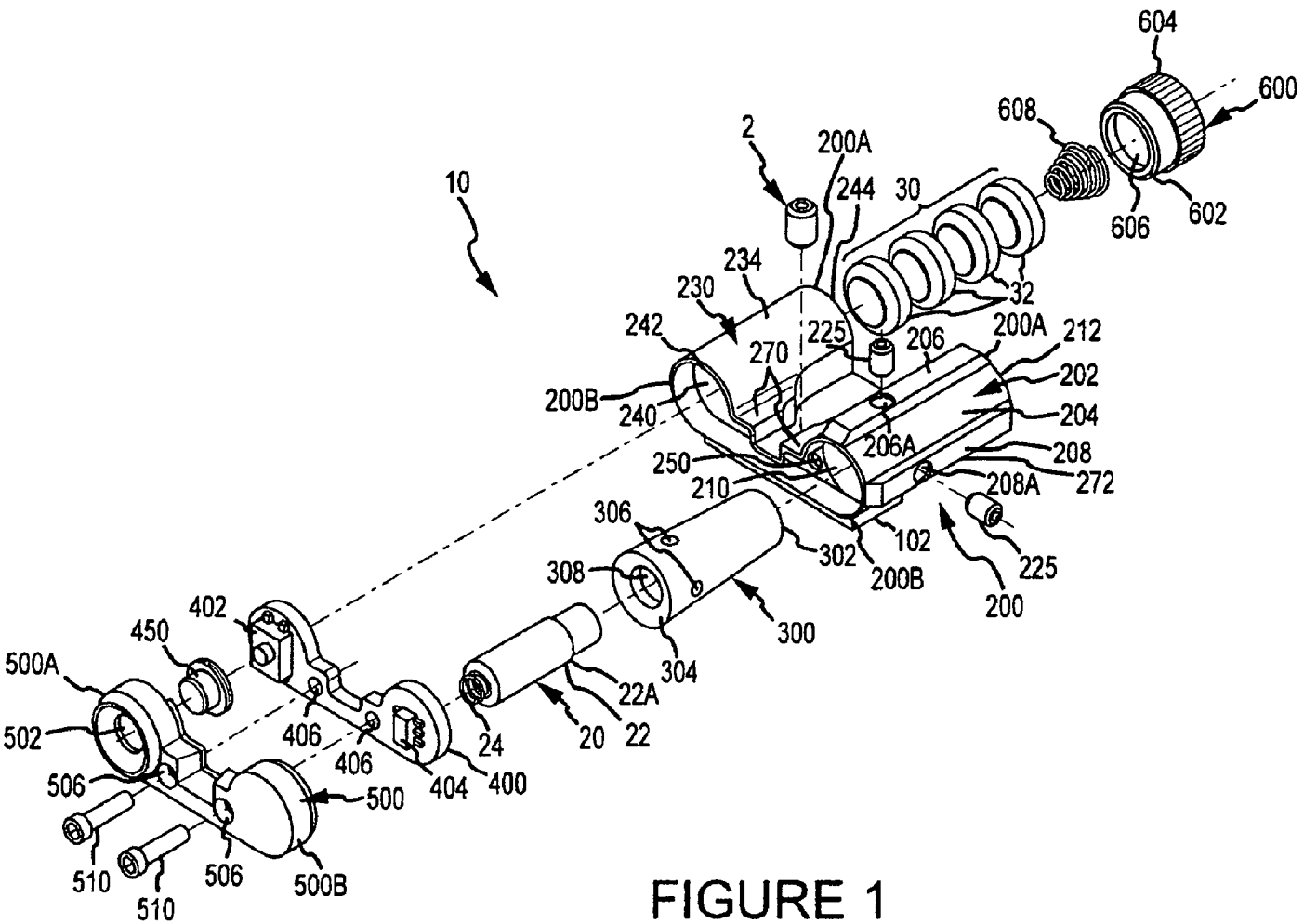
FIG. 1 is an exploded view of an embodiment of the present invention.

Turning now to the drawings where the purpose is to describe a preferred embodiment of the invention and not to limit same, FIGS. 1-11 show a preferred embodiment of a device 10 according to the invention. Device 10 as shown is a laser sight, but could be any structure that includes one or more light sources and one or more power sources connectable to the light source(s) and that can be mounted to a gun in the manner described herein.

Preferably, device 10 is configured to be mounted in a slot, formed in the top surface of a gun, wherein device 10 provides a lighting source and preferably still allows a user to mechanically sight the gun. The slot (best seen in FIGS. 9 and 13) 2010 is known to those skilled in the art (if the slot is on the top surface of the gun it preferably extends the entire width of the top surface), and in one embodiment (for a Glock 19 pistol) is 1" wide and 0.080" deep. Device 10 could also be mounted to the top, rear portion or side, rear portion of a gun in any other suitable, fashion that allows the gun to be properly holstered in a standard holster (i.e., one not specially made to accommodate the device, but made solely to holster the gun) and that allows the light source to be projected along a side surface of the gun or along the top surface of the gun. For example, device 10 could be mounted to the gun using a U-shaped or L-shaped bracket.

When mounted on a gun device 10 preferably extends no farther from the back of the gun than about 2½", 2", 1½" or 1¼" and extends outward from the top surface or side surface of the gun no further than about ¾", ½", ⅜" or 0.313". Device 10, and each device described herein, as shown preferably has an entire length L (seen best in FIG. 1B) of less than 3", or less than 2", or less than 1½", less than 1" and preferably about 0.875", and preferably has a height H (seen best in FIG. 1A) of less than ¾", or less than ½" and preferably about ⅜".

Device 10 includes a light source 20, a power source 30 and a housing 200 that includes a mount 102, which as shown is a bottom rail that fits into a slot formed on a gun.

Light source 20 has a first end 20A (through which light can be emitted), is preferably a visible-light laser module, but could be any light source, including a light emitting diode ("LED") flashlight (as used herein "flashlight" means any source of visible light other than a laser) or an infra-red light source (such as an infra-red LED or infra-red laser). In the embodiment shown light source 20 is a red-light, 650 nanometer, 3.3 mm diode, visible laser, and the laser module has an overall length of about 14 mm and a diameter of about 4.5 mm. It includes a 3 mm focal length, collimating lens. Any suitable laser/laser module may be used, however. A biasing spring 24 is attached to second end 20B to bias light source 20 towards first end 20A when device 10 is assembled.

Power source 30 can be any suitable power source for light source 20, and is preferably an electric power source and most preferably a portable, electrical power source such as a battery or multiple batteries. The embodiment shown uses four 1-3 silver oxide 1.5V silver oxide LR626 batteries 32, although any suitable batteries or other power source may be used.

Device 10 as shown further includes a housing 200, a light source adjustment apparatus 300, an integrated circuit board 400, a backing 500, and a battery cap 600. The purpose of housing 200 is to retain light source 20 and power source 30 and mount them to a gun, and to selectively connect power source 30 to light source 20. Any suitable structure or structures may be used for this purpose.

Housing 200 is preferably made of metal injection molded stainless steel (MIM), but could be made of any suitable material, such as another metal (for example, MIM carbon steel or extruded aluminum) or plastic. Housing 200 has a first end 200A, a second end 200B and includes a first canister 202 and a second canister 230. First canister 202 is configured to receive and retain the light source 20 (which is preferably a laser module), which as shown is first positioned in light source adjustment apparatus 300. Once so positioned, apparatus 300, with light source 20 inside, is positioned in and retained in canister 202.

As shown, canister 202 has an outer surface 204, a first rib 206, a second rib 208, an inner cavity 210 in which apparatus 300 and light source 20 are retained, and an opening 212 through which the light source 20 can emit light. Canister 202 also includes an aperture 206A that extends through rib 206 to inner cavity 210 and an aperture 208A that extends through rib 208 to inner cavity 210. Each of apertures 206A and 208A are configured to receive a moveable screw or screw 225 (hereafter referred to as "set screw" or "set screws," which are preferably socket-head set screws). The purpose of rib 206 and rib 208 (each of which project outward about 0.075") are to provide additional area to support set screws 225. Alternatively, a raised portion (described, for example with respect to device 10', device 1000 and device 2000) may be used in place of rib 206 and/or 208. Other structures may be used for this purpose or no such structure may be used.

Second canister 230 as shown is spaced apart from first canister 202 and is configured to receive and retain the power source 30. Canister 230 as shown has an outer surface 234, an inner cavity 240, a first end 242 and a second end 244. Second end 244 is configured to open in order to add or change power source 30. In the embodiment shown second end 244 includes internal threads (not shown) that mate with threads on power source retention cap 600 to allow cap 600 to be screwed onto end 244 and screwed off of end 244 in order to add or remove power source 30 from canister 230.

Housing 200 also includes a connective portion 270 that connects first canister 202 and second canister 230. Connective portion 270 has a bottom surface 272 and a mount 102 attached to or integrally formed with bottom surface 272. Mount 102 is for mechanically attaching device 10 to a gun and any suitable structure or structures may be used for this purpose.

As shown in this embodiment, mount 274 is a generally a rail configured to be received in the slot (which may have a dovetail shape) formed on a gun. An aperture (not shown) may be formed in housing 200, in connective portion 270. A set screw 2 is received in the aperture and tightened so that it creates a pressure fit against a surface (preferably the base of a slot) of the gun to assist in retaining the device on the gun.

An opening 200S is formed in housing 200 to create a mechanical sight that, in this embodiment, forms the rear, mechanical sight for a gun to which device 10 is mounted. As persons skilled in the art understand, the rear mechanical sight is visually aligned with the front mechanical sight to properly sight a gun. Alternatively, an apparatus including a gun with device 10 attached can be sighted using light source 20.

Figure 1A:
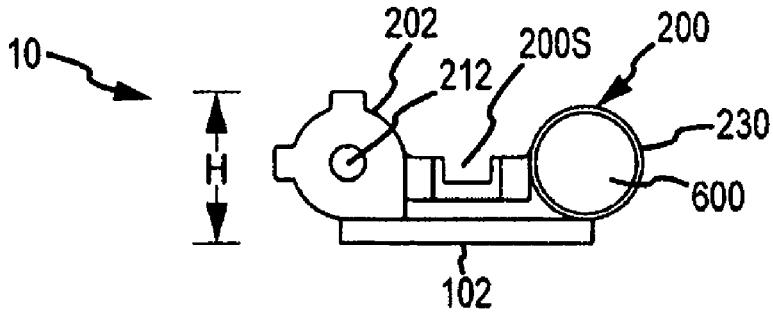
FIG. 1A is a front view of the assembled device shown in FIG. 1.
Figure 1B:
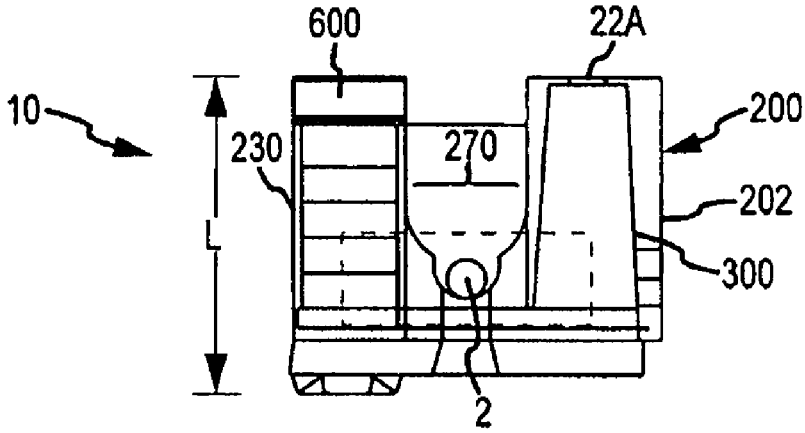
FIG. 1B is a top view of the device shown in FIGS. 1 and 1A.
Figure 1C:
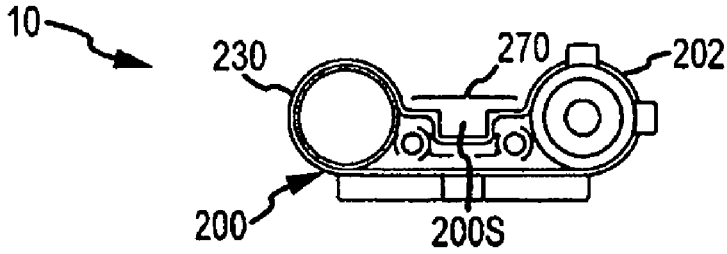
FIG. 1C is a rear view of the device shown in FIGS. 1-1B but without the backing or the button yet attached.
Figure 1D:
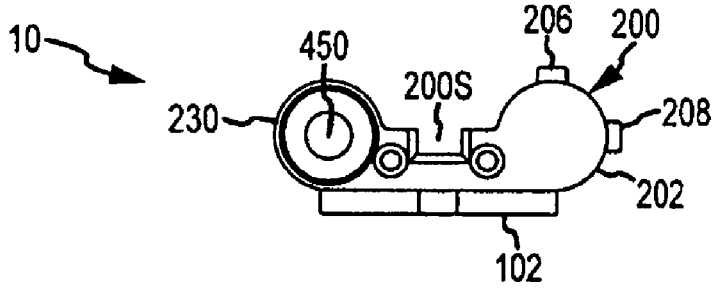
FIG. 1D is a rear view of the device shown in FIGS. 1-1C when fully assembled.
Figure 1E:
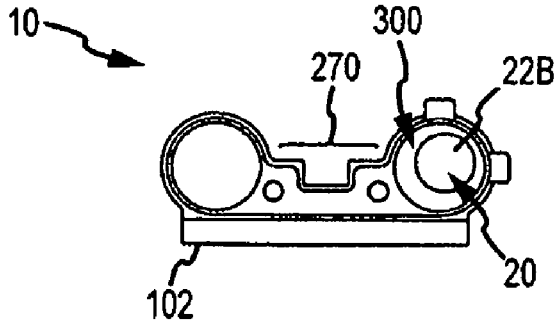
FIG. 1E is a rear view of the device shown in FIGS. 1-1D without the backing or the integrated circuit board and showing the laser module biased to one side (the laser biasing spring also is not shown).
Figure 1F:
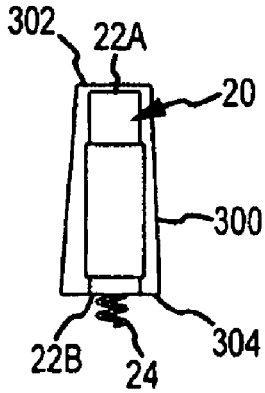
FIG. 1F is a partial, cross-sectional top view of a light source biased to one side of the biasing cone (or light source adjustment apparatus).

Light source adjustment apparatus (or "LSAA") 300 is for retaining the light source 20 when it is positioned in housing 200 and for assisting in positioning light source 20. LSAA 300 serves two purposes: (1) it absorbs the recoil of a gun to which device 10 is mounted thereby enabling light source 20 to remain in a relatively stable position, and (2) it enables a user to adjust the position of light source 20. As shown in FIG. 1, LSAA 300 is generally conical with a first, smaller diameter end 302 and a second, large diameter end 304. It is preferably comprised of an elastomeric material, such as neoprene rubber, of about a 60 Shore A to absorb shock, but can be made of any suitable material. It has an opening 308 configured to receive light source 20. As previously described, LSAA 300 fits into inner cavity 210 of first canister 202.

When device 10 is assembled the position of light source 20 can be adjusted utilizing set screws 225. LSAA 300 is shaped to be biased towards apertures 206A and 208A and, as one or both set screws 225 are tightened, the set screw(s) pushes against LSAA 300 and moves it (in this embodiment) either to the side and/or downward thereby adjusting the position of light source 20.

Integrated circuit board 400 is configured to be received and mounted on second end 200B of housing 200. The basic purpose of board 400 is to connect the power source 30 to the light source 20 and any suitable structure or device can be used for this purpose. Board 400 is preferably plastic and includes a push button switch 402, an integrated circuit 404 and two through screw holes 406. Current is transferred via board 400 to laser module 20. Board 400 is designed for negative switching wherein power is generated from the negative side of power source 30 (which are batteries in this embodiment) and through spring 24 of light source 20 in this embodiment. Integrated circuit 404 allows for the pulsed delivery of power to light source 20 (preferably about 1,000 cycles per second, and preferably pulsing at a 50% on duty rate) in order to save power and power source life, although the delivery of power need not be pulsed, or can be pulsed in any suitable manner. In this embodiment, the light source has between a 8 and 15 milliamp draw, and most preferably less than a 10 milliamp draw, of current when in use and utilizing the 1,000 pulses per minute delivery of current to light source 20.

A button 450 is of any suitable shape to fit with push button switch 402 and backing 500, described below. Button 450 is for enabling a user to selectively activate switch 402 thus turning the light source 20 off and on, and any suitable device or structure can be used for this purpose.

Backing 500 is preferably plastic and its purpose is to hold integrated circuit board 400 to housing 200 and to protect integrated circuit board 400 and the other components inside of housing 200. Backing 500 has a first side 500A configured to fit over canister 202 at end 200B and a second side 500B configured to fit over end 242 of canister 230. It further includes an opening 502 through which button 450 projects so it can be pressed by a user to turn light source 20 on and off, and openings 506 that align with screw holes 406 and screw retainers 250. Screws 510 are then received through openings 506 and screw holes 406, and are threaded into retainers 250 to hold device 10 together.

Power source retention cap 600 has a threaded end 602 and an end 604 that can be tightened or loosened by a user. The purpose of cap 600 is to selectively open and close second canister 230 to allow power source 30 to be removed or inserted and any structure capable of performing this function can be used. Cap 600 has a cavity 606 that receives a spring 608 to bias batteries 32 away from spring 608. Spring 608 contacts the positive side of the power source 30 and grounds it to the housing 200 through cap 600. As explained below, a rubber biasing collar 620 may also be utilized with cap 600.

Figure 1G:
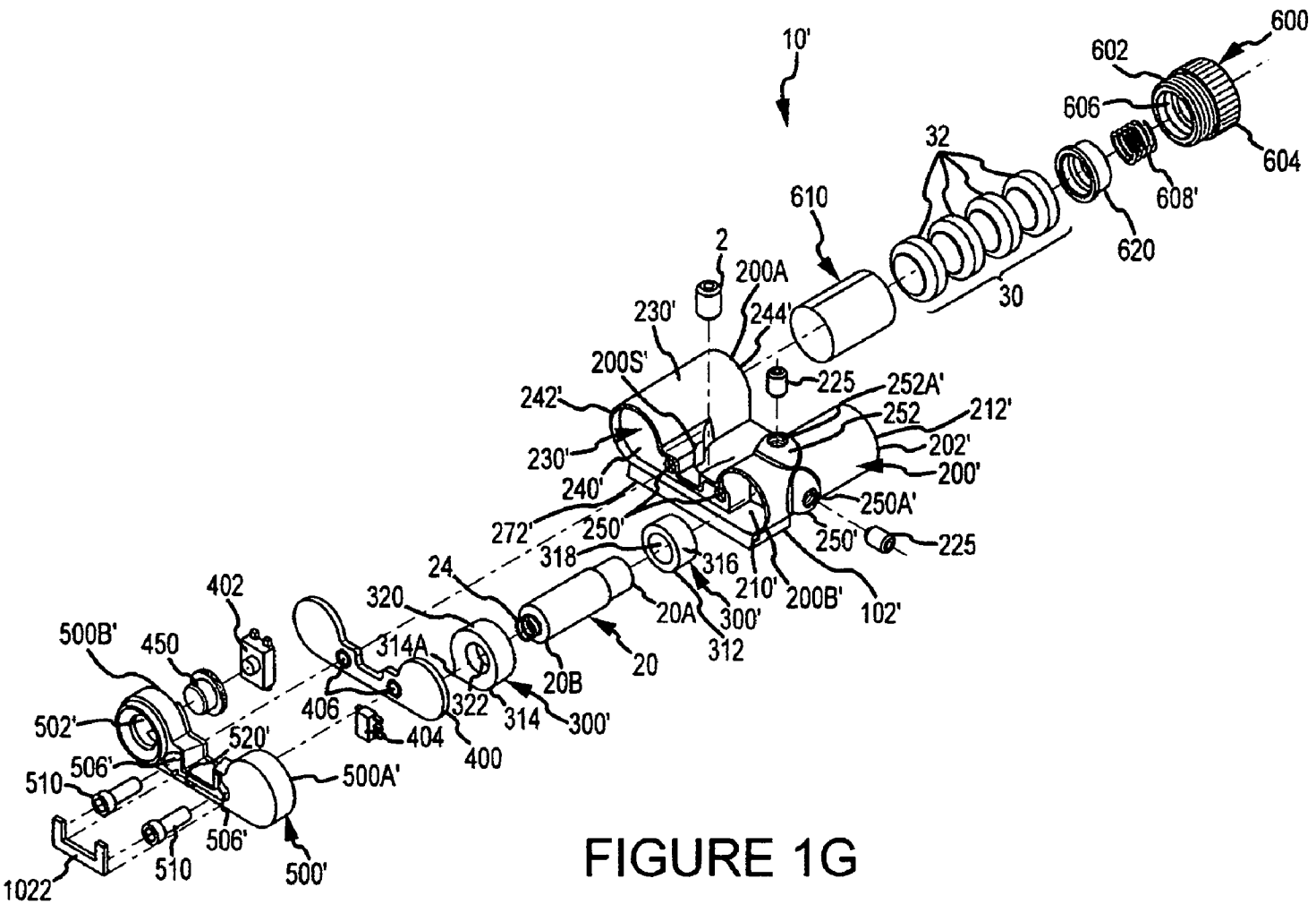
FIG. 1G is an exploded view of an alternative embodiment of the present invention.
Figure 2:
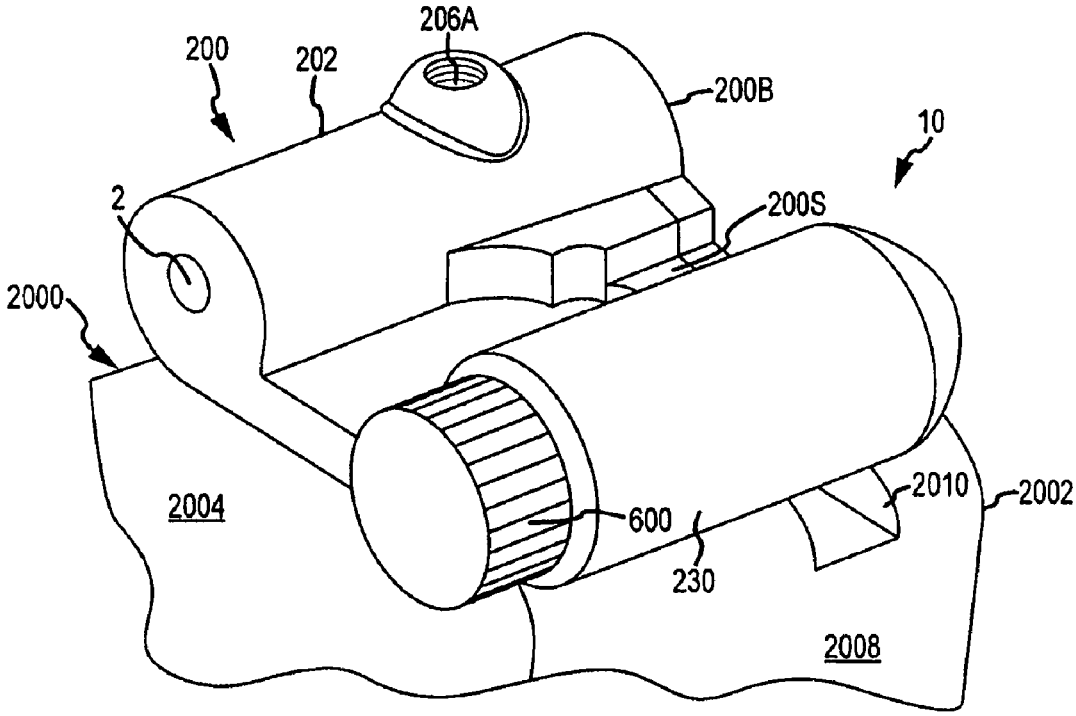
FIG. 2 is a side, perspective view showing the embodiment of FIG. 1 mounted in the slot of a gun.
Figure 3:
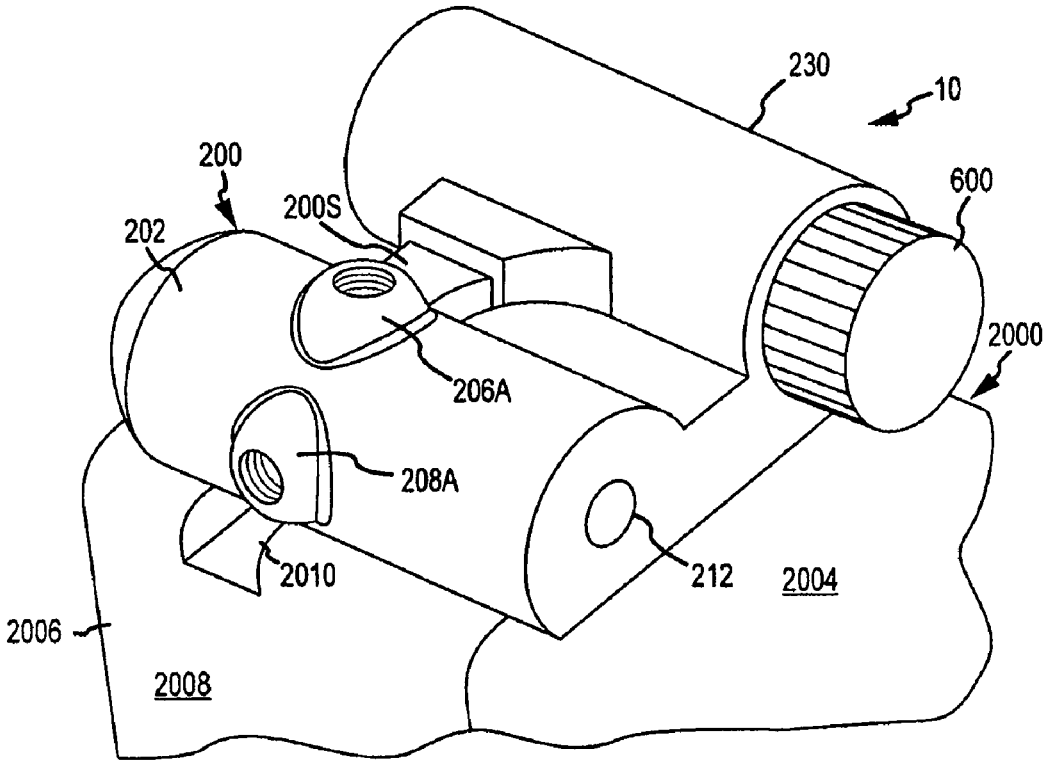
FIG. 3 is an alternate side, perspective view of the embodiment shown in FIGS. 1 and 2.
Figure 4:
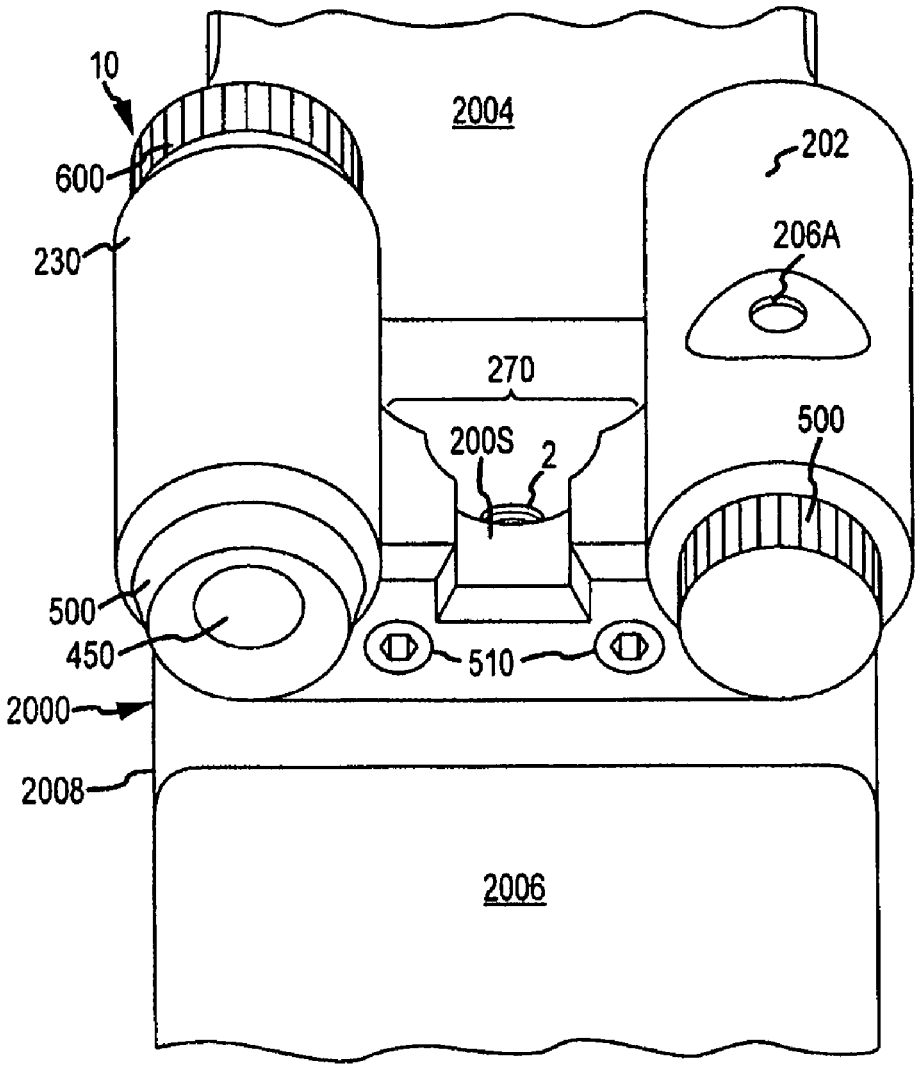
FIG. 4 is a rear, top, perspective view of the embodiment shown in FIGS. 1-3.
Figure 5:
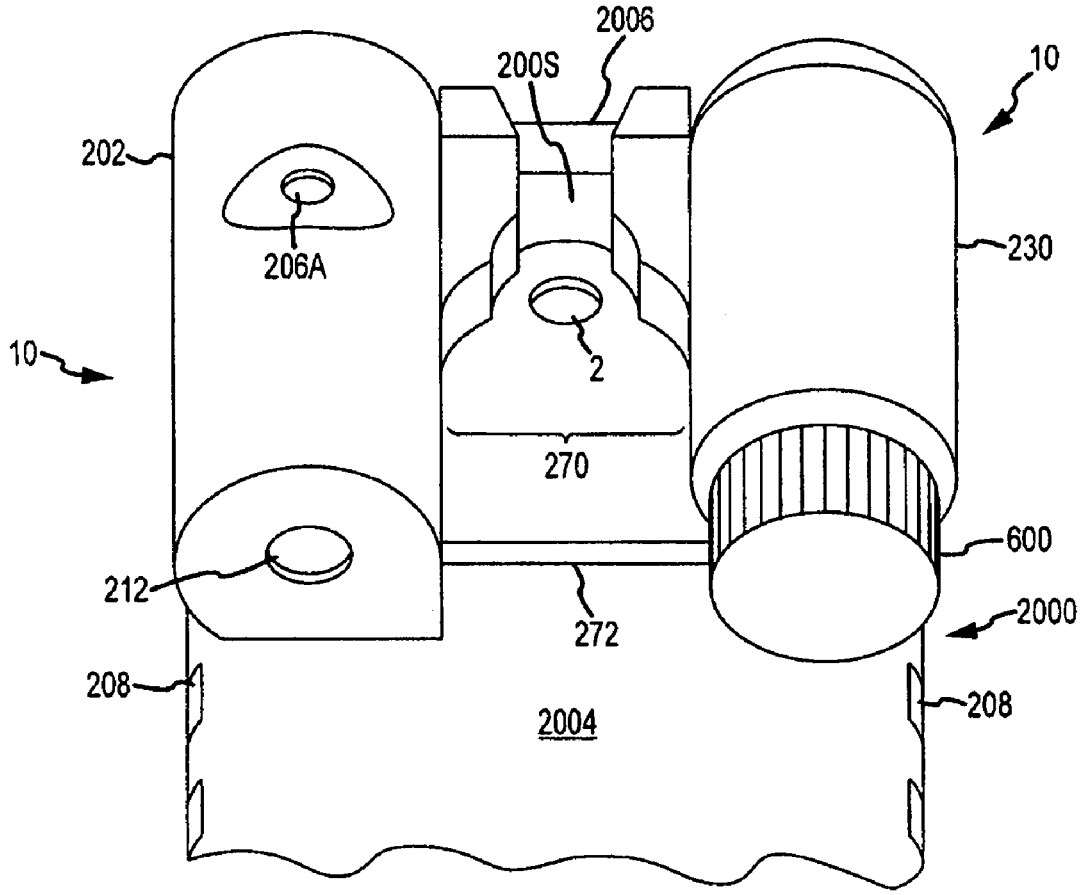
FIG. 5 is a front, top, perspective view of the embodiment shown in FIGS. 1-4.
Figure 6:
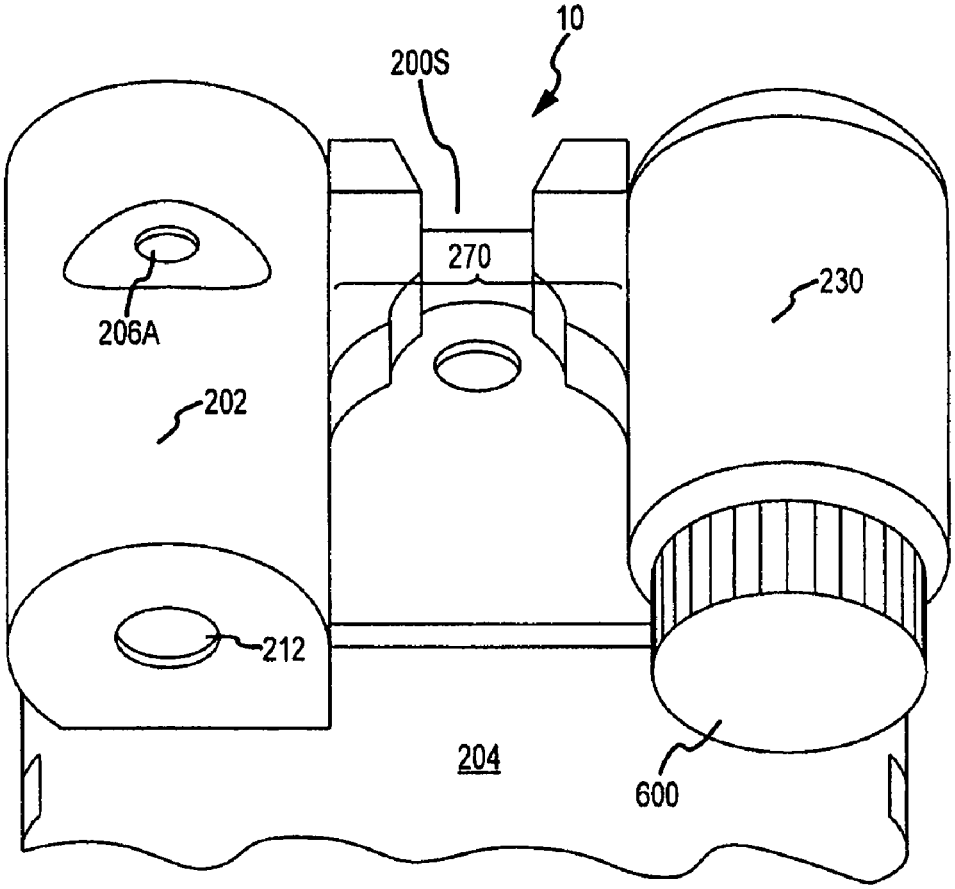
FIG. 6 is a close-up, rear, top, perspective view of the embodiment shown in FIGS. 1-5.
Figure 7:
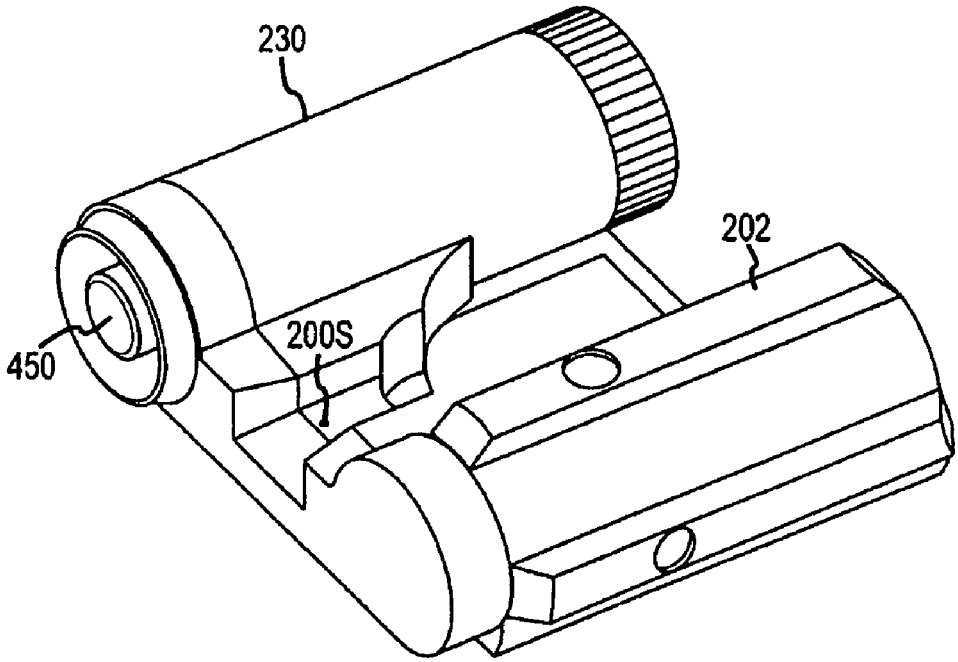
FIG. 7 is a rear, perspective view of a device according to the invention.
Figure 8:
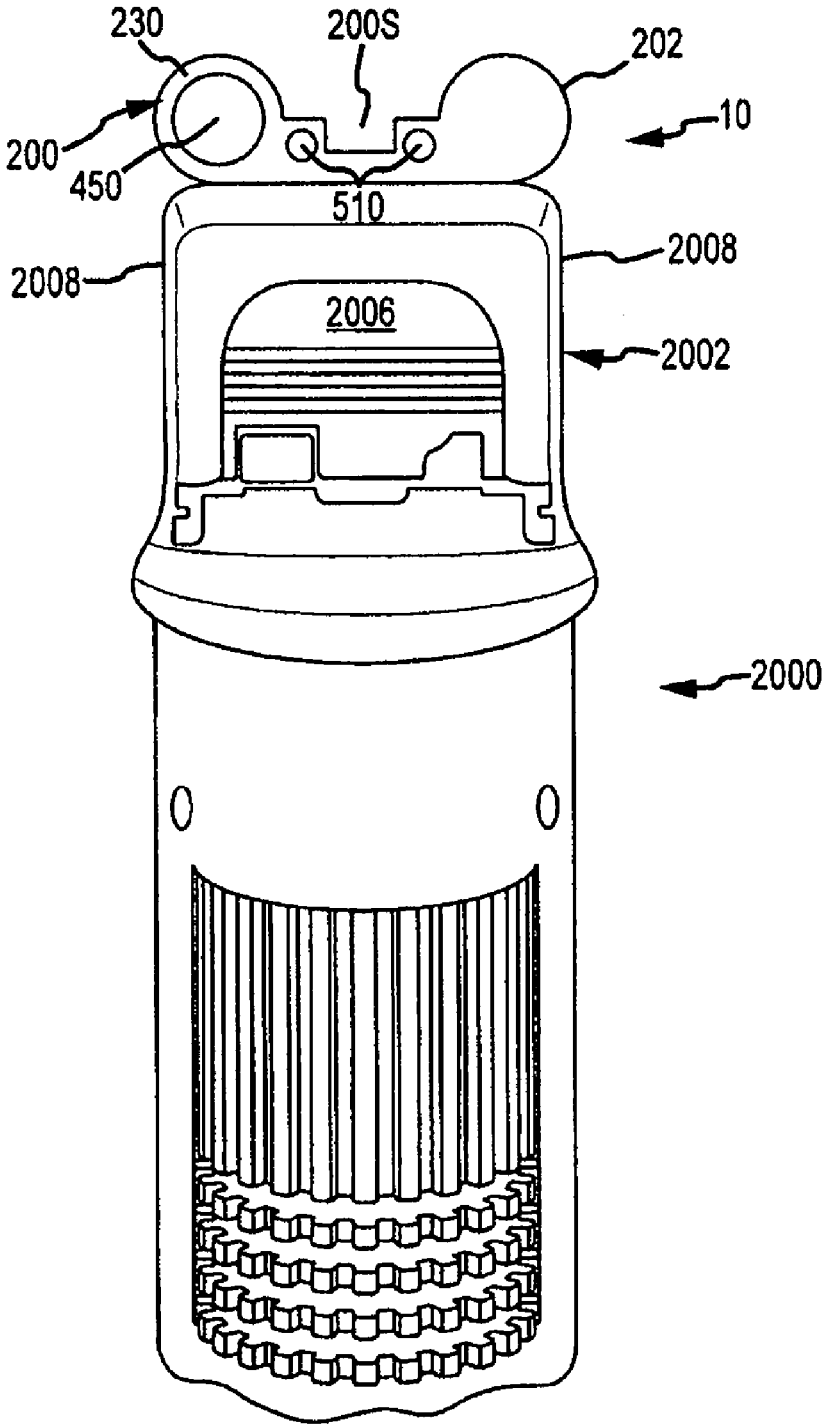
FIG. 8 is a rear view of the embodiment shown in FIGS. 1-7 mounted to one embodiment of a gun with which the device may be used.
Figure 9:
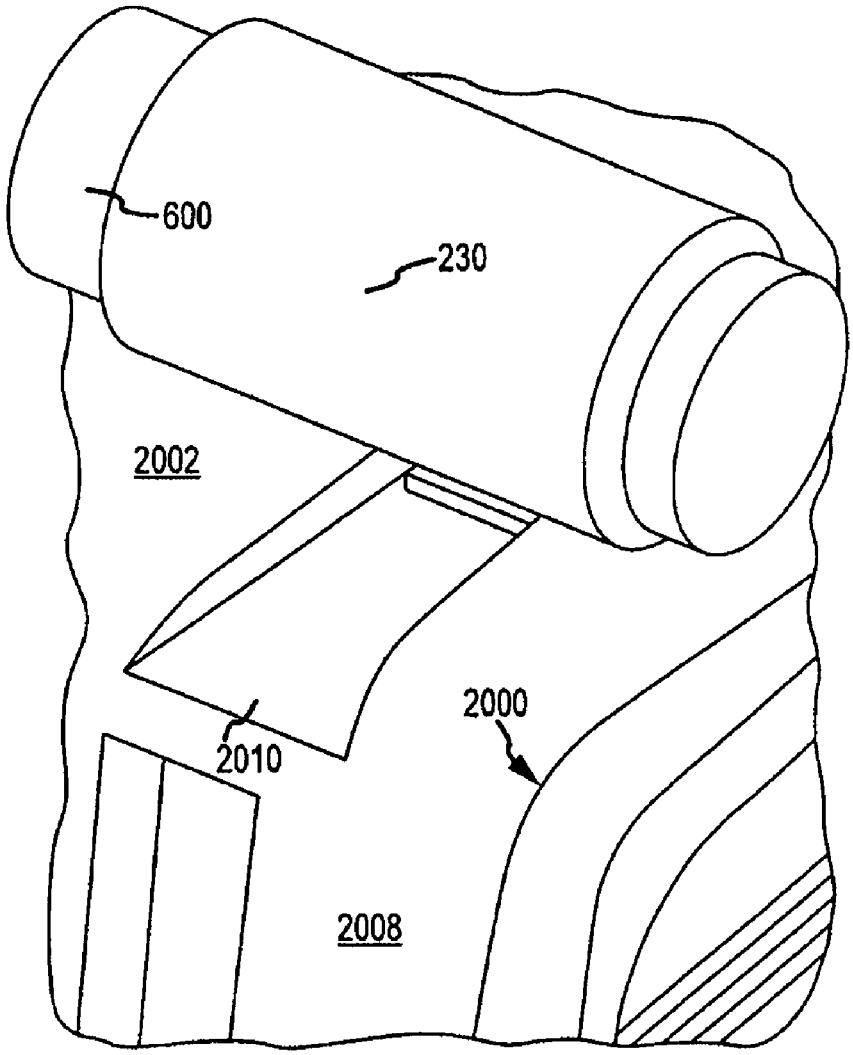
FIG. 9 is a close-up, side, perspective view of the embodiment shown in FIGS. 1-8 and showing the slot on a gun into which the device is mounted.
Figure 10:
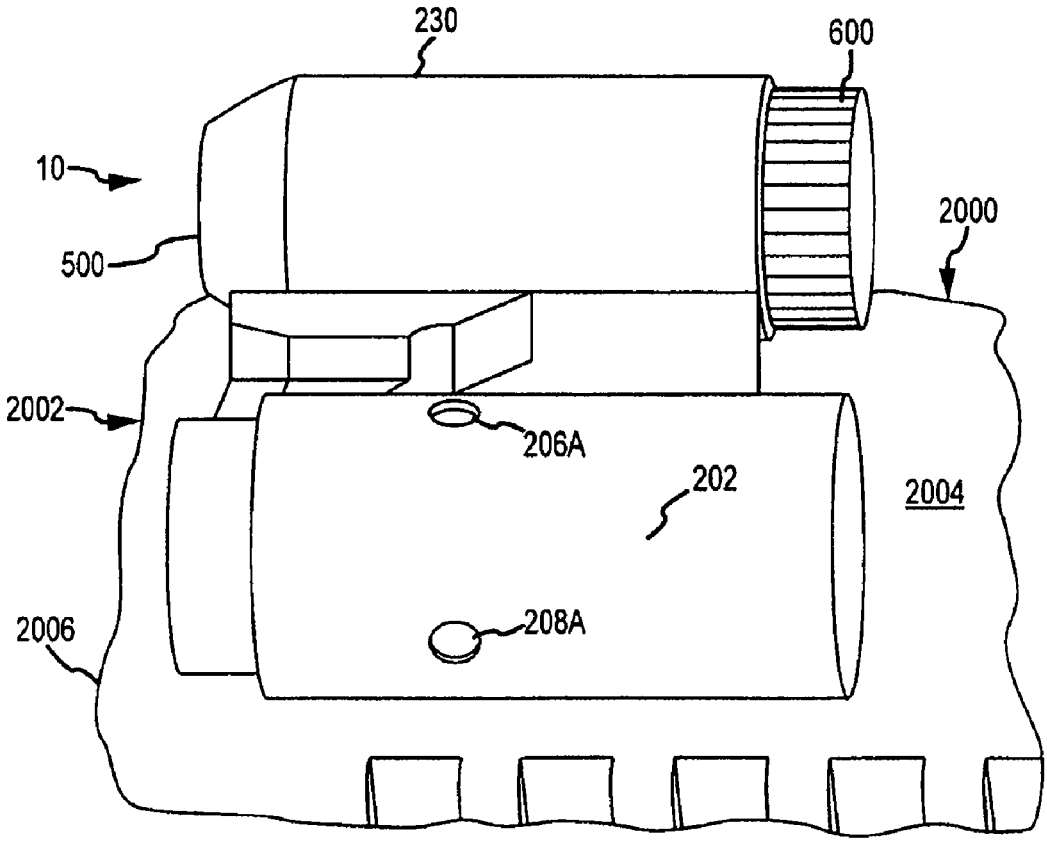
FIG. 10 is a top, side, perspective view of the device shown in FIGS. 1-9 mounted on a gun.
Figure 11:
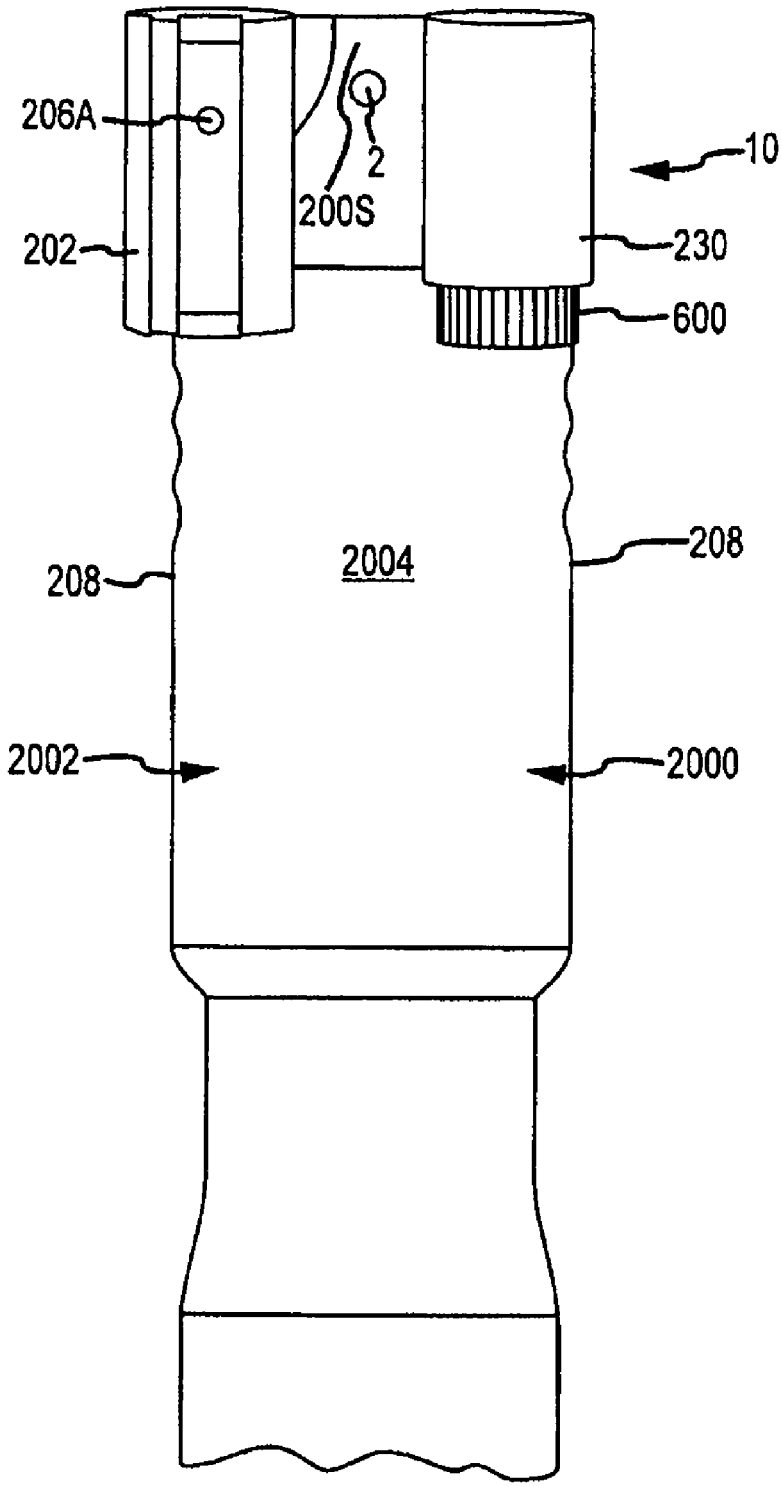
FIG. 11 is a top view of the embodiment of the invention shown in FIGS. 1-10 mounted on a gun.

FIG. 1G shows an alternate embodiment of the invention, device 10'. The preferred embodiment of device 10' is preferably identical in all respects to device 10 except that it includes a modified housing 200' with a modified mechanical sight, a modified LSAA 300', an insulating sleeve 610 and a biasing collar 620. Only the features that are different from those already described with respect to device 10 shall be described in detail.

Figure 15:
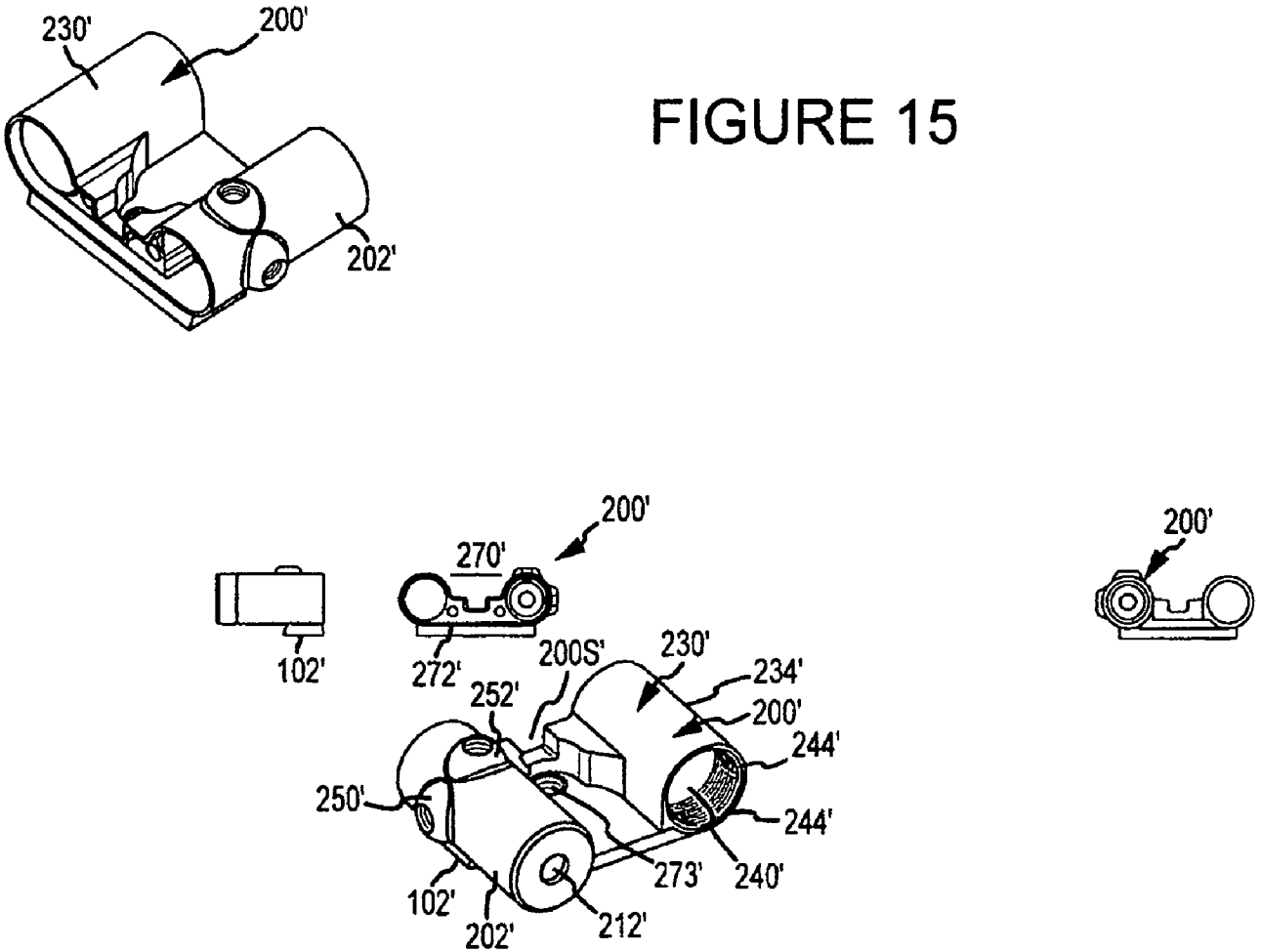
FIG. 15 shows various views of housing 200'.
Figure 16:
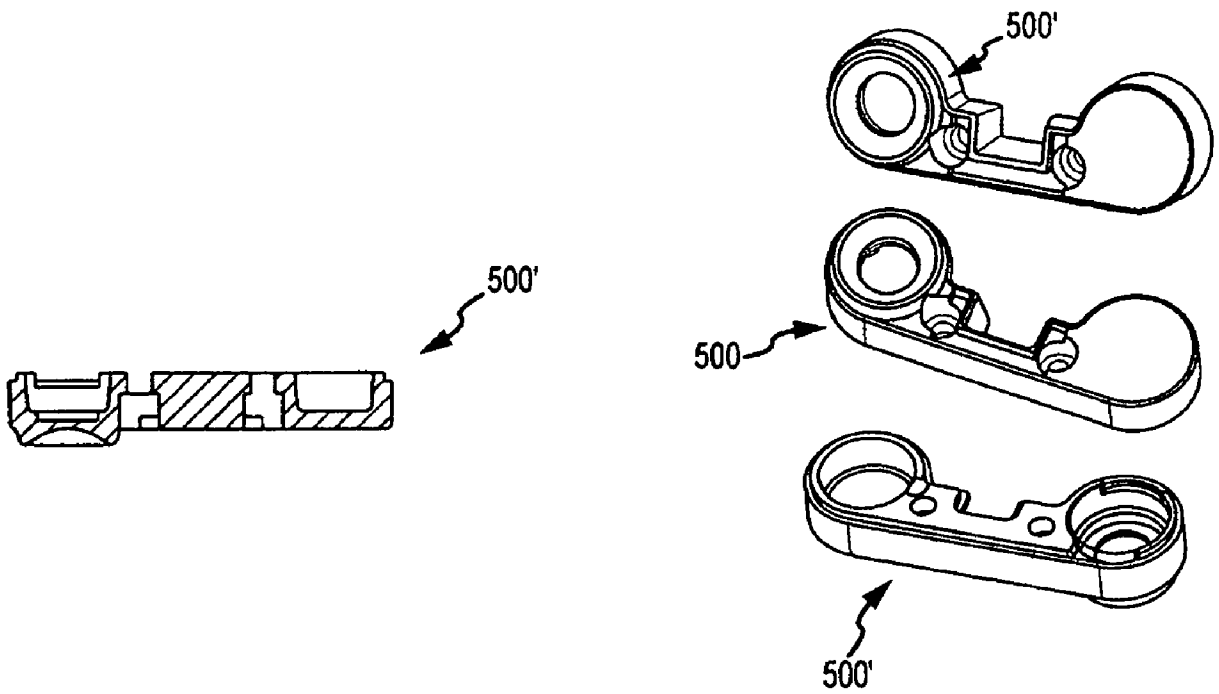
FIG. 16 shows various views of backing 500'.

Housing 200' (which is also shown in FIG. 15) is preferably made of MIM stainless steel, but could be made of any suitable material, such as any suitable metal (for example, MIM carbon steel or extruded aluminum) or plastic. Housing 200' has a first end 200A', a second end 2008' and includes a first canister 202' and a second canister 230'. First canister 202' is configured to receive and retain the light source 20, which as shown is first positioned in light source adjustment apparatus 300', and then apparatus 300', with light source 20 inside, is positioned and retained in canister 202'.

As shown, canister 202' has an outer surface 204', a first projection 206', a second projection 208', an inner cavity 210' in which apparatus 300' and light source 20 are retained, and an opening 212' through which the light source 20 can emit light. Canister 202' also includes an aperture 206A' that extends through projection 206' to inner cavity 210' and an aperture 208A' that extends through projection 208' to inner cavity 210'. Each of apertures 206A' and 208A' are configured to receive a moveable screw or screw 225 (previously described). The purpose of projection 206' and projection 208' (each of which project outward 0.075") are to provide additional area to support set screws 225. Other structures may be used for this purpose or no such structure may be used.

Second canister 230' as shown is spaced apart from first canister 202' and is configured to receive and retain the power source 30. Canister 230' as shown has an outer surface 234', an inner cavity 240', a first end 242' and a second end 244'. Second end 244' is configured to open in order to add or change power source 30. In the embodiment shown second end 244' includes internal threads (shown in FIG. 15) that mate with threads on power source retention cap 600 to allow cap 600 to be screwed onto end 244' and screwed off of end 244' in order to add or remove power source 30 from canister 230'.

Housing 200' also includes a connective portion 270' that connects first canister 202' and second canister 230'. Connective portion 270' has a bottom surface 272' and a mount 102' attached to or integrally formed with bottom surface 272'. Mount 102' is for mechanically attaching device 10 to a gun and any suitable structure or structures may be used for this purpose. As shown in this embodiment, mount 274' is a generally a rail configured to be received in the slot (which may have a dovetail shape) formed on a gun. An aperture 273' (shown in FIG. 15) may be formed in housing 200', in connective portion 270'. A set screw 2 is received in the aperture 273' and tightened so that it creates a pressure fit against a surface (preferably the base of a slot) of the gun to assist in retaining the device on the gun.

An opening 200S' is formed in housing 200' to create a mechanical sight that, in this embodiment, forms the rear, mechanical sight for a gun to which device 10' is mounted. As persons skilled in the art understand, the rear mechanical sight is visually aligned with the front mechanical sight to properly sight a gun. Alternatively, a gun using device 10' can be sighted using light source 20, which is preferably a visible light laser.

The purpose of LSAA 300' is the same as for previously described LSAA 300 and any suitable structure may be utilized. LSAA 300'; as shown in FIGS. 1G and 12-14, has a first collar 312 and a second collar 314, and this structure of the LSAA may be used with any suitable structure of a device according to the invention, including device 10, device 10', device 1000 or device 2000. First collar 312 as shown is tubular with an annular wall 316, passage 318, and it receives first end 20A of light source 20 in passage 318. Second collar 314 has an outer wall 320, a passage 322 and receives second end 20B of light source 20 in passage 322. Second collar 314 also includes a projection 314A on one side to bias light source 20 to a particular position in chamber 210. Each collar 312 and 314 is preferably comprised of elastomeric material, such as neoprene rubber of about 60 Shore A, to absorb shock, but either can be made of any suitable material.

When collars 312 and 314 are positioned so that each receives a respective end of light source 20, light source 20 with the collars 312 and 314 is placed inside of chamber 210. LSAA 300' is shaped to be biased towards apertures 250A and 252A. Once positioned inside of chamber 210, the position of light source 20 can be adjusted by tightening or loosening set screws 225 (previously described). For example, as one or both set screws 225 are tightened, the set screw(s) pushes against light source 20 and moves it either to the side and/or downward (in this embodiment) thereby adjusting the position of light source 20 within cavity 210'.

Backing 500' is preferably stainless steel, but could be made of any suitable material, and its purpose is to hold integrated circuit board 400 to housing 200' and to protect integrated circuit board 400 and the other components inside of housing 200'. Backing 500' has a first side 500A' configured to fit over canister 202' at end 200B' and a second side 500B' configured to fit over end 242' of canister 230'. It further includes an opening 502' through which button 450 projects so it can be pressed by a user to turn light source 20 on and off, and openings 506' that align with screw holes 406 and screw retainers 250'. Screws 510 are then received through openings 506' and screw holes 406, and are threaded into retainers 250 to hold device 10 together. Backing 510' further includes an indentation 520' configured to receive a sighting insert 1022 (described in more detail below) to assist in mechanical sighting.

Power source retention cap 600 has been previously described. Device 10' also includes an insulating sleeve 610 (which may be used with other embodiments of the invention, such as device 10, device 1000 or device 2000) formed of a suitable material, such as MYLAR, to prevent power source 30 from grounding to the inner wall of cavity 240.

A biasing collar 620 has an annular wall 622, a lip 624 and an opening 626 therethrough. Biasing collar 620 fits into cavity 606 of cap 600. Spring 608', which has a slightly different configuration but the same function as previously described spring 608, is received within opening 626. Biasing collar 600 assists in holding power source 30 in place during movement of device 10' and helps to prevent device 10' from turning on or off without a user intending to do so. Biasing collar 620 may be used with other embodiments of the invention, such as with device 10, device 1000 or device 2000, and is preferably comprised of 60 Shore A neoprene rubber although any suitable material may be used.

Figure 12:
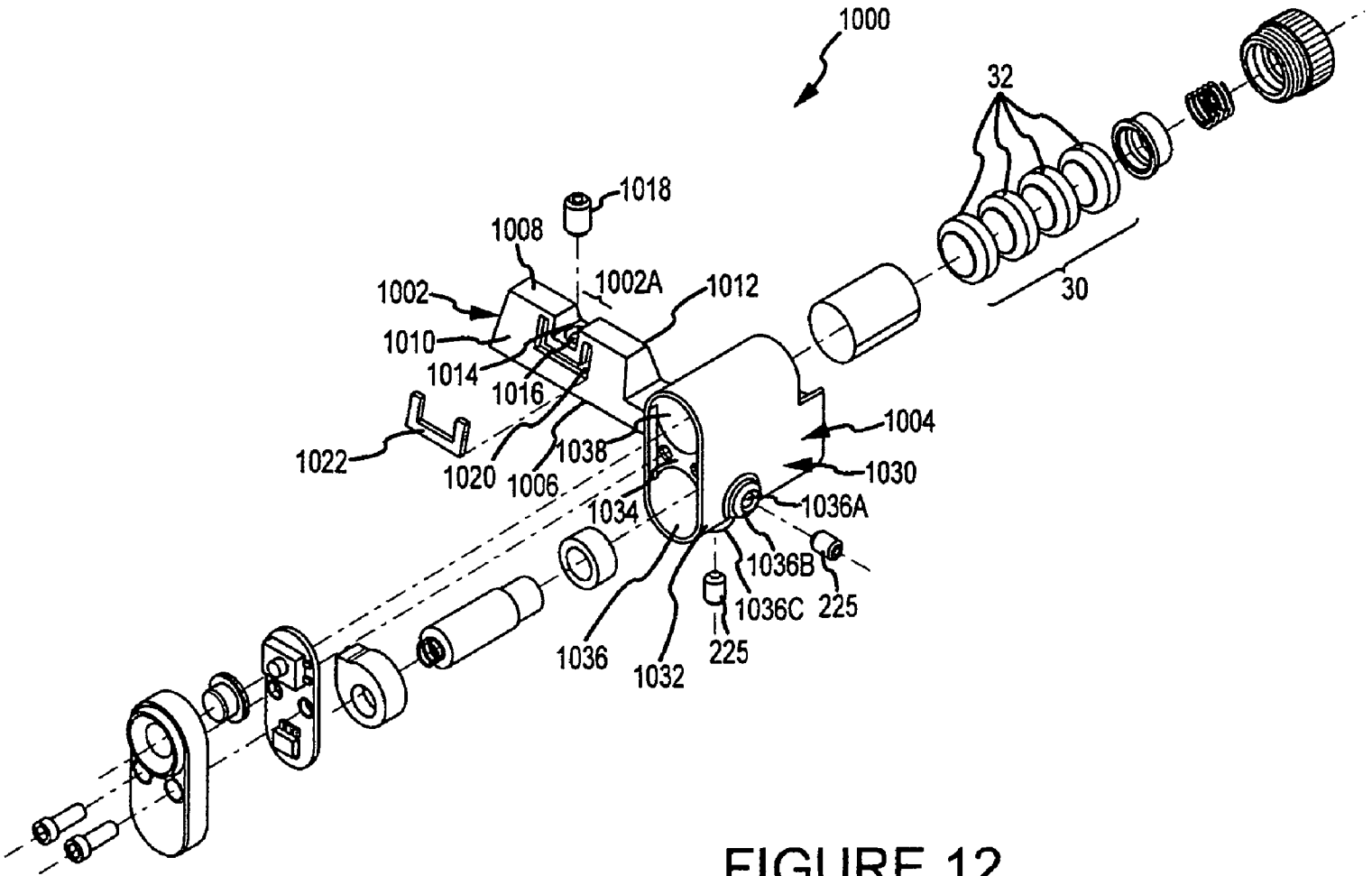
FIG. 12 is an alternate embodiment of a device according to the invention that is generally L-shaped, having a first leg and a second leg.
Figure 13:
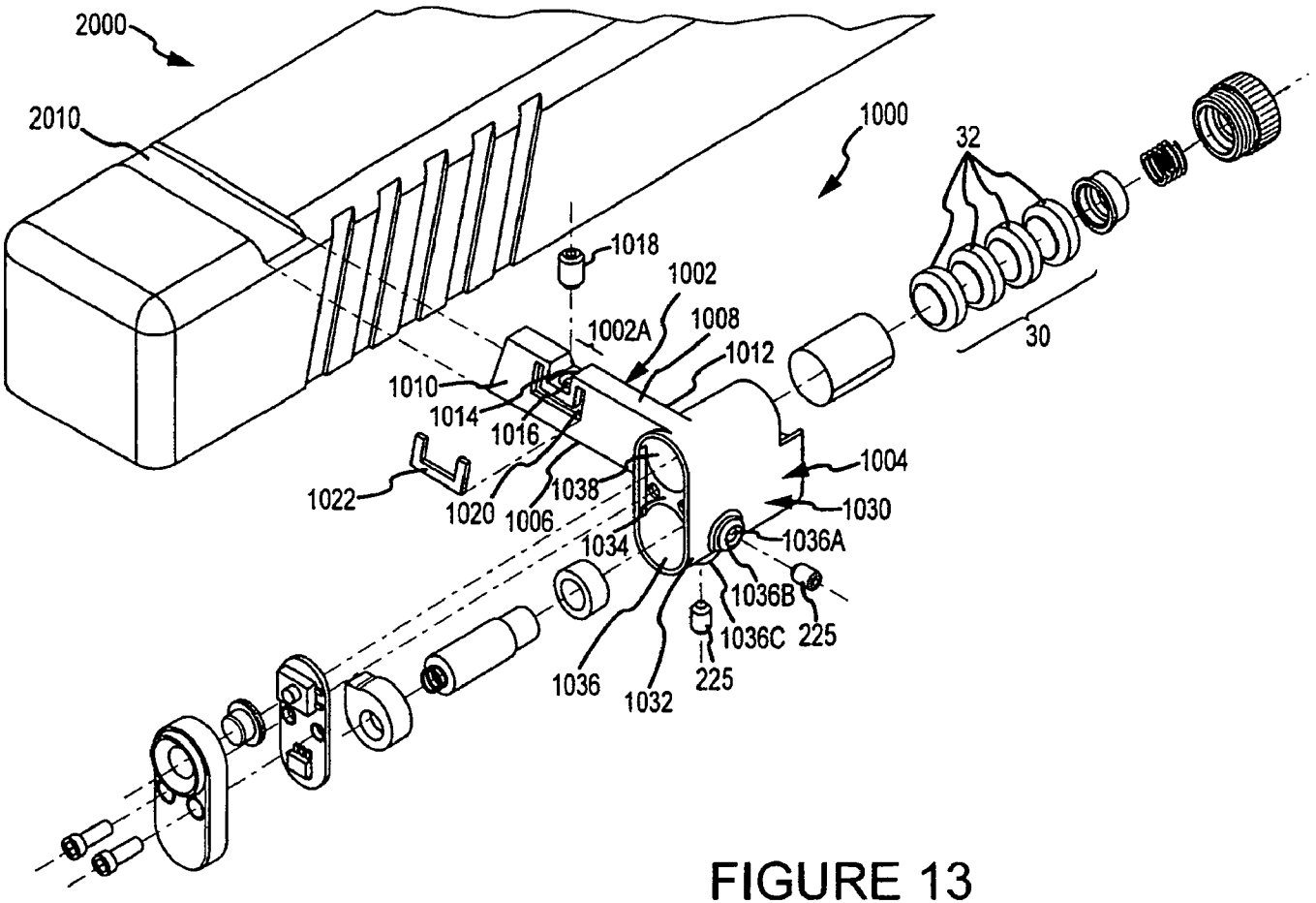
FIG. 13 is a prospective view of a device that is L-shaped and that shows how the device would mount to a slot of one type of gun.

A sighting device according to the invention may be mounted to a gun in any suitable manner utilizing any suitable structure, and may be formed in an L-shape, T-shape or a U-shape. FIGS. 12 and 13 show a device 1000 according to an aspect of the invention wherein the light source may be positioned on a side surface of a gun by, in this embodiment, forming device 1000 in an L-shaped or T-shaped configuration. Device 1000 is basically L-shaped and has a first leg 1002 and a second leg 1004. First leg 1002 is shown as being integrally formed with second leg 1004, but could be attached to second leg 1004 in any suitable manner.

First leg portion 1002, in this embodiment, includes a mechanical sight portion 1002A, a base 1006 (which functions as a mount to attached to the slot of a gun), a top 1008, a first side 1010 and a second side 1012. In this embodiment, base 1006 is configured to fit into a slot on a gun (as shown in FIG. 13), but device 1000 can have any structure on first leg portion 1002 and/or second leg portion 1004 capable of attaching to a gun.

Mechanical sight portion 1002A in first leg 1002 includes an opening 1014. An aperture 1016 passes through base 1006. A set screw 1018, which as shown is a socket head set screw, is threadingly received in aperture 1016 when first leg portion 1002 is positioned in a slot (such as slot 2010 shown in FIG. 13), and set screw 1018 is tightened until it presses against the surface of the slot to assist in retaining device 1000 to the gun.

First side 1010 includes an indentation 1020 that receives a sighting insert 1022 to assist in mechanically sighting the gun when device 1000 is mounted on the gun. Sighting insert 1022 may be pressure fit, snap fit and/or glued into indentation 1020, or attached to device 1000 in any suitable fashion. Other devices or structures applied to or formed as part of first leg 1002 could alternatively be used to assist in mechanical sighting, or no mechanical sight may be included. Sighting insert 1022 or any other mechanical sighting device could be luminescent (meaning it glows in the dark) and/or of any color, and white is one preferred color. The device could be the same color as the front mechanical sight (not shown) on the gun to assist the user in aligning the rear mechanical sight and front mechanical sight when aiming the gun.

Second leg 1004 as shown includes a housing 1030. Housing 1030 has an outer wall 1032 and an inner dividing wall 1034 that divides structure 1030 into two chambers 1036 and 1038. Housing 1030 is preferably made of metal injection molded steel, but could be made of any suitable material, such as any suitable metal or plastic, including extruded aluminum. Chamber 1036 is for retaining a light source 20 (which was previously described and is preferably a laser) and chamber 1038 is for retaining a power source 30 (which was previously described and is preferably a plurality of batteries 32). As shown, housing 1030 has an outer surface 1032, a first projection 1036B and a second projection 1036C. An aperture 1036A passes through first projection 1036B and into cavity 1036 and a second aperture (not shown) passes through second projection 1036C and into cavity 1036. Each of these apertures is for receiving a set screw 225 (previously described). The purpose of projection 1036B and 1036C (each of which extend about 0.075" outward from outer surface 1032) is to provide additional thickness to support set screws 225. Other structures may be used for this purpose or no such structure may be used.

A light source adjustment apparatus (or "LSAA") 300 or 300' is preferably used in this embodiment and has the same function and a preferred structure as previously described with respect to device 10 or device 10'.

Integrated circuit board 400A is configured to be received and mounted on second end 1030A of housing 1030. The purpose and function of board 400A is the same as previously described circuit board 400, and any suitable structure or device can be used for this purpose. Board 400A is preferably fiberglass and includes a push button switch 402A, an integrated circuit 404A and two through screw holes 406A.

A button 450A is preferably plastic and of any suitable shape to fit with push button switch 402A and backing 500A, described below. Button 450A is for enabling a user to selectively activate switch 402A thus turning the light source 20 off and on, and any suitable device or structure can be used for this purpose.

Backing 500A is preferably plastic or metal and its purpose is to hold integrated circuit board 400A to housing 1036 and to protect integrated circuit board-400A and the other components inside of housing 1036. Backing 500A has a first side 502A configured to fit over housing 1036 at end 1036A. Backing 500A further includes an opening 504A through which button 450A projects so it can be pressed by a user to turn light source 20 on and off, and openings 506A that align with screw holes 406A and screw retainers 250A. Screws 510A are then received through openings 506A and screw holes 406A, and are threaded into screw retainers 250A to hold device 1000 together.

Figure 14:
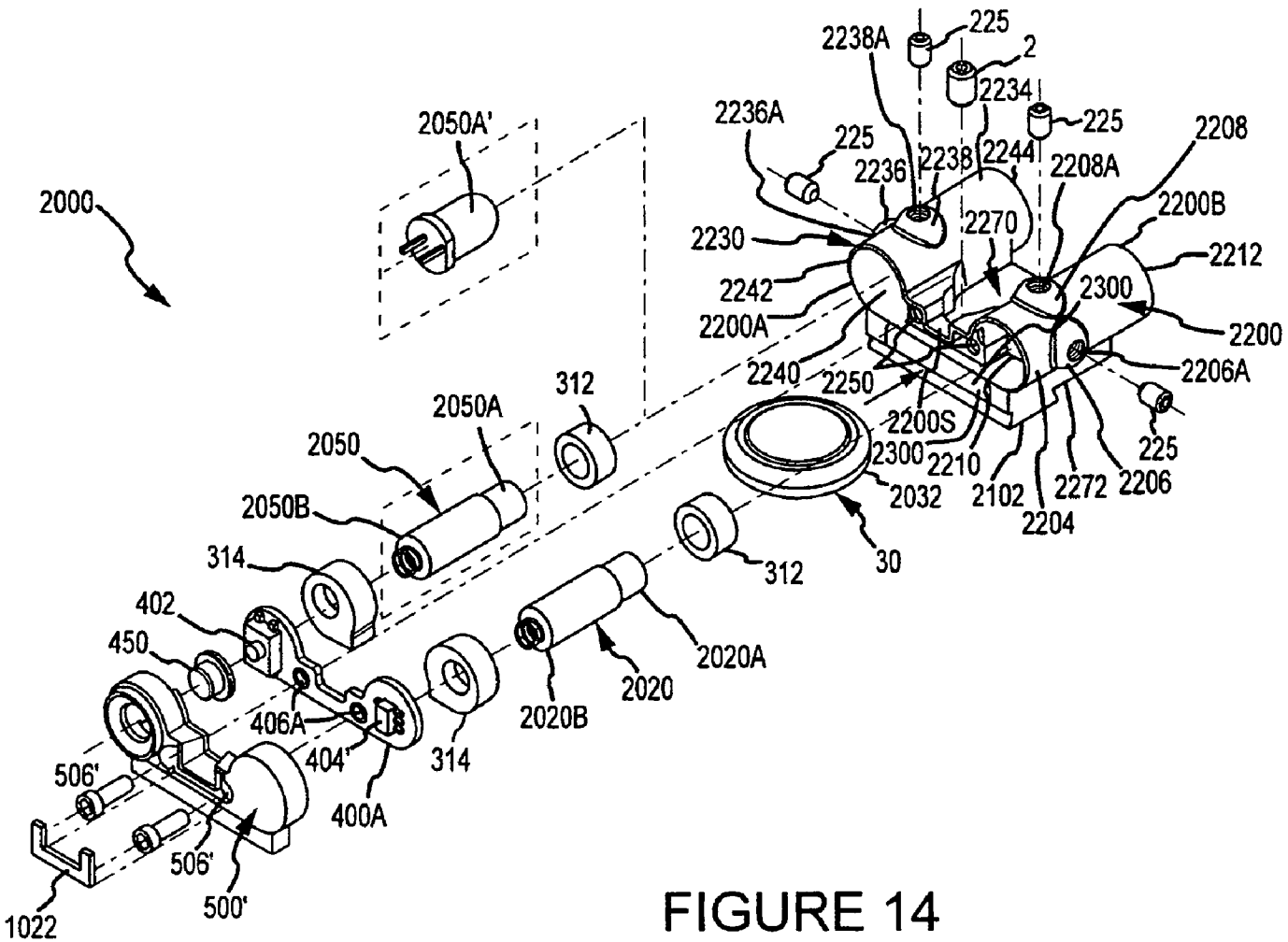
FIG. 14 is an alternate embodiment of a device according to the invention that includes two light sources.

FIG. 14 shows a device 2000 according to the invention that includes two light sources. Each light source could be of any type, such as a visible laser, an LED flashlight, an infra-red LED, or an infra-red laser. Any combination is possible and each light source may emit the same type of light or may emit different types of light. For example, one light could be a visible laser and one could be an LED flashlight, or both could be visible lasers, or one could be an infra-red laser and the other could be an infra-red LED. Utilizing device 2000 each of the respective light sources may be operated independently of one another or may both be simultaneously operated. For example, an LED flashlight and visible laser may simultaneously be operated to enable a user to simultaneously see in a dark area and sight the gun.

As shown, the two light sources are side by side and device 2000 is configured to be on the top surface of a gun. However, one light source could be above the other (similar to the configuration of the light source and power source shown for device 1000 in FIGS. 12 and 13), or one light source could be on the top surface of the gun and another on a side surface.

Housing 2200 is preferably made of MIM stainless steel, but could be made of any suitable material, such as any suitable metal (for example, MIM carbon steel or extruded aluminum) or plastic. Housing 2200 has a first end 2200A, a second end 2200B and includes a first canister 2202 and a second canister 2230. First canister 2202 is configured to receive and retain the light source 2020, which as shown is first positioned in light source adjustment apparatus 300' (which was previously described), and then LSAA 300', with light source 2020 inside, is positioned and retained in canister 2202. As shown, canister 2202 has an outer surface 2204, a first projection 2206, a second projection 2208, an inner cavity 2210 in which LSAA 300' and light source 2020 are retained, and an opening 2212 through which the light source 20 can emit light. Canister 2202 also includes an aperture 2206A that extends through projection 2206 to inner cavity 2210 and an aperture 2208A that extends through projection 2208 to inner cavity 2210. Each of apertures 2206A and 2208A are configured to receive a moveable screw or screw 225 (previously described). The purpose of projection 2206 and projection 2208 (each of which project outward about 0.075") are to provide additional area to support set screws 225. Other structures may be used for this purpose or no such structure may be used.

Second canister 2230 as shown is spaced apart from first canister 2202 and is configured to receive and retain second light source 2050. Canister 2230 as shown has an outer surface 2234, an inner cavity 2240, a first end 2242 and a second end 2244 through which light source 2050 can emit light. Second canister 2230 is configured to receive and retain the light source 2050, which as shown is first positioned in light source adjustment apparatus 300' (which was previously described), and then LSAA 300', with light source 2050 inside, is positioned and retained in canister 2230.

Canister 2230 also includes an aperture 2236A that extends through projection 2236 to inner cavity 2240 and an aperture 2238A that extends through projection 2238 to inner cavity 2240. Each of apertures 2236A and 2208A are configured to receive a moveable set screw or screw 225 (previously described). The purpose and preferred configuration of each projection 2236 and 2238 are the same as for projections 2206 and 2208. Other structures may be used for this purpose or no structure may be used.

Housing 2200 also includes a connective portion 2270 that connects first canister 2202 and second canister 2230. Connective portion 2270 has a bottom surface 2272 and a mount 2102 attached to or integrally formed with bottom surface 272. Mount 2102 is for mechanically attaching device 2000 to a gun and any suitable structure or structures may be used for this purpose. As shown in this embodiment, mount 2274 is a generally a rail configured to be received in the slot (which may have a dovetail shape) formed on a gun. An aperture (not shown) may be formed in housing 2200, in connective portion 2270. A set screw 2 is received in the aperture and tightened so that it creates a pressure fit against a surface (preferably the base of a slot) of the gun to assist in retaining the device on the gun.

An opening 2200S is formed in housing 2200 to create a mechanical sight that, in this embodiment, forms the rear, mechanical sight for a gun to which device 2000 is mounted. As persons skilled in the art understand, the rear mechanical sight is visually aligned with the front mechanical sight to properly sight a gun. Alternatively, a gun using device 2000 can be sighted using light source 2020 and/or light source 2050, at least one of which is preferably a laser.

Device 2000 includes a power source retention cavity 2300 that houses a power source 30. In this embodiment, power source 30 is a single 3V lithium coin cell battery. However, as previously described, power source 30 could be of any suitable type and be positioned in any suitable location to power each of the light sources and the power source may include different batteries connected to different ones of the light sources.

Integrated circuit board 400A is configured to be received and mounted on second end 2200 of housing 2200. The purpose and function of board 400A is the same as previously described circuit board 400, except that integrated circuit 404' can be used to turn on either the first light source, the second light source, or both of the light sources at the same time, and any suitable structure or device can be used for this purpose. Board 400A is preferably fiberglass and includes a push button switch 402A, and two through screw holes 406A.

A button 450 (previously described) is preferably plastic and of any suitable shape to fit with push button switch 402 (previously described) and backing 500A, described below. Button 450 selectively activates switch 402 thus turning the light source 2020 and/or 2050 off and on, and any suitable device or structure can be used for this purpose.

Backing 500' is preferably stainless steel, but could be of any suitable material, and its purpose is to hold integrated circuit board 400A to housing 2200 and to protect integrated circuit board 400A and the other components inside of housing 2200. Backing 500' has the same preferred structure as previously described and preferably includes sighting insert 1022. Screws 510A are received through openings 506' and screw holes 406A, and are threaded into retainers 2250 to hold device 2000 together.

A preferred gun 2000 is a semi-automatic pistol, although a sighting device according to the invention can be used on any gun having the proper configuration for the sighting device to be mounted thereon. FIGS. 3-6, 8-11 and 13 show one preferred embodiment of a gun with which a device according to the invention can be used. Gun 2000 as shown is a Glock 17 pistol although a sighting device according to the invention may be used with any gun on which it can be properly mounted. A device according to the invention is preferably used with a semi-automatic pistol such as a Glock 17, 19, 21 or 23.

Gun 2000 includes a slide 2002, a top surface 2004 (which as shown slide 2002), a rear surface 2006, two side surfaces 2008, a slot 2010 and a handle or grip 2012. Slot 2010 preferably has a dovetail shape. As shown, slot 2010 is formed in the top surface of gun 2000, near rear surface 2006, and preferably within 2" of rear surface 2006.

When assembled to gun 2000, a device according to the invention as shown is mounted by pressure fitting the mount (such as mount 102) into slot 2010. Usually the gun, such as gun 2000, is provided with two mechanical sights: one on the top surface near the front of the gun barrel (called the front sight), and another on the top surface near the rear surface (called the rear sight). The rear mechanical sight is often mounted in a slot, such as slot 2010, and it must first be removed in order to mount a device according to the invention in the slot, if the device is mounted in the slot.

Having thus described some embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired result.

What is claimed is:

1. A sighting device mountable on a gun, the gun having a grip and a body portion including a barrel, the body portion having a top surface, a back surface adjacent the top surface and above the grip, and two side surfaces wherein each side surface is adjacent the top surface, and a slot positioned on either one of the side surfaces or the top surface, the slot being within 2 inches of the back surface, the sighting device including a first light source and a power source connectable to the first light source, the first light source having a first mode in which it emits light and a second mode in which it does not emit light, the sighting device mechanically mountable in the slot so that the light emitted by the first light source travels along side either the top surface or one of the side surfaces of the gun.

2. The sighting device of claim 1 wherein the first light source is a laser.

3. The sighting device of claim 1 wherein the first light source is a visible laser.

4. The sighting device of claim 1 wherein the first light source is an infra-red laser.

5. The sighting device of claim 1 wherein the first light source is a LED flashlight.

6. The sighting device of claim 1 wherein the first light source is a LED infra-red light.

7. The sighting device of claim 1 wherein the first light source extends no farther than ¾" outward from the surface on which it is mounted.

8. The sighting device of claim 1 wherein no part of the sighting device extends farther than ¾" outward from the surface on which it is mounted.

9. The sighting device of claim 1 wherein the first light source extends no farther than ⅜" outward from the surface on which it is mounted.

10. The sighting device of claim 1 wherein no part of the sighting device extends farther than ⅜" outward from the surface on which it is mounted.

11. The sighting device of claim 1 that further includes a light source adjustment apparatus for mechanically adjusting the position of the first light source.

12. The sighting device of claim 11 wherein the light source adjustment apparatus comprises one or more set screws.

13. The sighting device of claim 11 wherein the light source adjustment apparatus further comprises a sleeve that at least partially surrounds the first light source.

14. The sighting device of claim 13 wherein the sleeve of the light source adjustment apparatus includes an inner cavity that retains at least part of the first light source.

15. The device of claim 14 wherein the sleeve of the light source adjustment apparatus has a conical shape.

16. The sighting device of claim 13 wherein the sleeve of the light source adjustment apparatus is moved by adjusting one or more of the set screws, thereby adjusting the position of the first light source.

17. The sighting device of claim 11 wherein the first light source includes a first end and a second end and the light source adjustment apparatus includes a first collar that fits over the first end and a second collar that fits over the second end.

18. The sighting device of claim 11 that further includes a housing with a plurality of apertures and a set screw threadingly received in each aperture, the set screws for adjusting the position of the first light source.

19. The sighting device of claim 13 wherein the sleeve of the light source adjustment apparatus is comprised of elastomeric material.

20. The sighting device of claim 17 wherein the first collar and the second collar of the light source adjustment apparatus is comprised of elastomeric material.

21. The sighting device of claim 1 wherein the power source is one or more batteries.

22. The sighting device of claim 1 wherein the power source is spaced apart from the first light source.

23. The sighting device of claim 1 wherein the power source is positioned under the first light source.

24. The sighting device of claim 1 that further includes a mechanical sight.

25. The sighting device of claim 24 wherein the mechanical sight includes a sighting insert.

26. The sighting device of claim 25 wherein the sighting device includes a housing for retaining the power source and the first light source and the sighting insert is a different color than the housing.

27. The sighting device of claim 25 wherein the sighting insert is luminescent.

28. The sighting device of claim 1 wherein the slot has a dove tail shape.

29. The sighting device of claim 1 that includes a mount that may be pressure fit into the slot.

30. The sighting device of claim 29 that includes an aperture in the mount, the aperture for receiving a set screw that can be tightened against the base of the slot to secure the sighting device to the gun.

31. The sighting device of claim 1 that further includes a second light source.

32. The sighting device of claim 31 wherein the second light source is spaced apart from the first light source.

33. The sighting device of claim 32 wherein there is a mechanical sight between the first light source and the second light source.

34. The sighting device of claim 31 wherein the first light source is a laser.

35. The sighting device of claim 31 wherein the first light source and second light source are each connectable to the power source.

36. The sighting device of claim 1 wherein the power source is positioned under the first light source.

37. The sighting device of claim 31 wherein the second light source is an infra-red light.

38. The sighting device of claim 31 wherein the second light source is a flashlight.

39. The sighting device of claim 31 wherein the second light source is a LED flashlight.

40. The sighting device of claim 31 wherein the second light source is a visible light or infra-red laser.

41. The sighting device of claim 31 wherein the first light source and the second light source each emit the same type of light.

42. The sighting device of claim 31 wherein the first light source and second light source each emit a different type of light.

43. The sighting device of claim 31 wherein the first light source and the second light source are each positioned above the top surface of the gun when the sighting device is mechanically mounted in the slot.

44. The sighting device of claim 32 that includes a first canister and a second canister, wherein the first canister includes the first light source, and the second canister includes one or more of the power source and the second light source.

45. The sighting device of claim 1 that is no greater than 3" in length.

46. The sighting device of claim 1 that is no greater than 2" in length.

47. The sighting device of claim 1 that is no greater than 1½" in length.

48. The sighting device of claim 1 that is no greater than 0.9" in length.

49. The sighting device of claim 1 wherein the power source is one or more batteries.

50. The sighting device of claim 49 wherein the power source is plurality of 1-3V silver oxide batteries.

51. The sighting device of claim 31 wherein the power source is four 1-3V silver oxide batteries.

52. The sighting device of claim 31 wherein the power source is one 3V coin cell lithium battery.

53. The sighting device of claim 31 that includes a housing, the housing including a first canister for retaining the first light source and a second canister for retaining the second light source.

54. The sighting device of claim 53 wherein at least part of the housing is comprised of metal.

55. The sighting device of claim 54 wherein at least part of the housing is comprised of aluminum.

56. The sighting device of claim 54 wherein at least part of the housing is comprised of steel.

57. The sighting device of claim 56 wherein at least part of the housing is comprised of stainless steel.

58. The sighting device of claim 54 wherein at least part of the housing is comprised of metal injection molded steel.

59. The sighting device of claim 53 wherein the housing includes a connective portion between the first canister and the second canister.

60. The sighting device of claim 59 wherein the mount is included on the connective portion.

61. The sighting device of claim 59 wherein the connective portion includes a mechanical sight.

62. The sighting device of claim 61 wherein the mechanical sight is positioned between the first canister and the second canister.

63. The sighting device of claim 60 that further includes an aperture for accepting a set screw, the aperture being formed through the mount and configured so that the set screw can pass through the mount and apply pressure to the slot to assist in retaining the sighting device to the gun.

64. The sighting device of claim 1 wherein the first light source pulses when it emits light.

65. The sighting device of claim 31 wherein the first light source and the second light source each pulses when it emits light.

66. The sighting device of claim 31 wherein the first light source and second light source can simultaneously emit light.

67. The sighting device of claim 64 wherein the first light source pulses at 1000 times per second when it emits lights.

68. The sighting device of claim 65 wherein the second light source pulses at 1000 times per second when it emits lights.

69. The sighting device of claim 1 wherein the first light source draws less than 10 milliamps of power when it emits light.

70. The sighting device of claim 1 wherein the first light source draws between 6-8 milliamps of power when it emits light.

71. The sighting device of claim 1 that is L-shaped and has a first leg and a second leg, wherein the mount is on the first leg and one or more of the light source and the power source is on the second leg.

72. The sighting device of claim 71 wherein the light source and power source are both on the second leg.

73. The apparatus of claim 71 that includes a first canister that includes the first light source.

74. The apparatus of claim 73 that further includes a second canister.

75. The apparatus of claim 74 wherein the first canister and the second canister are each cylindrical in shape.

76. The apparatus of claim 73 wherein the power source is in the first canister.

77. The apparatus of claim 74 that includes a mechanical sight between the first canister and the second canister.

* * * * *